US005357881A

United States Patent [19]

Elcik et al.

[11] Patent Number: 5,357,881

[45] Date of Patent: Oct. 25, 1994

[54] COMBINED POSITIVE CONTROLLED SLUDGE DRYER AND BURNER

[75] Inventors: Andrew W. Elcik, Raymond; John J. Devine, Portland; John H. Northrop, Falmouth; Kurt T. Dunn, Topsham; John F. Healey, Sanford, all of Me.

[73] Assignee: Northrop Engineering Corporation, Portland, Me.

[21] Appl. No.: 16,161

[22] Filed: Feb. 9, 1993

[51] Int. Cl.[5] ..... F23G 7/04

[52] U.S. Cl. ..... 110/346; 34/216; 110/224; 110/227; 110/228; 110/238; 110/186

[58] Field of Search ..... 34/216; 110/224, 227, 110/228, 346, 255, 257, 245, 185, 186

[56] References Cited

U.S. PATENT DOCUMENTS

| | | | |
|---|---|---|---|
| 4,643,108 | 2/1987 | Singelyn et al. | 110/228 |
| 4,827,853 | 5/1989 | Emery | 110/228 X |
| 5,191,845 | 3/1993 | Spliethoff | 110/346 |
| 5,233,763 | 8/1993 | Minnie, Jr. | 34/219 X |

*Primary Examiner*—Edward G. Favors
*Attorney, Agent, or Firm*—Laforest S. Saulsbury; Stanley R. Jones

[57] ABSTRACT

This invention comprises a combined cellulose sludge dryer and burner in which the drying procedure is positively and automatically controlled in response to the moisture content of the dewatered raw sludge supplied to the dryer headbox and carried through a drying chamber to discharge a dried sludge having but a 15% moisture content and suitable to be burned to provide the hot air for the drying procedure. With the sludge being critical as to charring, a temperature of 300 degrees Fahrenheit to prevent pre-burning and charring of the sludge has to be maintained in the drying chamber and positive and automatic control for the hot air to maintain the temperature is done by checking differences between input and output temperatures of the dryer and diluting the air produced by the burner by the use of a heat exchanger and air dampers. The extracted wet air from the drying chamber and diverted over-supply of air to the drying chamber are delivered through a scrubber and chimney to the atmosphere. A series of opposing hot air and wet air extracting ducts are provided in the drying chamber for the handling of the drying air to direct it from beneath the travelling wire screen conveyor through the sludge particles thereon and passed to the extracting air ducts thereabove whereby to increase speed for drying sludge and the efficiency of temperature control equipment. Programmable computers are included to establish the control requirements and maintain the desired temperatures throughout the drying and burning operations.

16 Claims, 4 Drawing Sheets

COMBINED POSITIVE CONTROLLED SLUDGE DRYER AND BURNER

Figure 1:
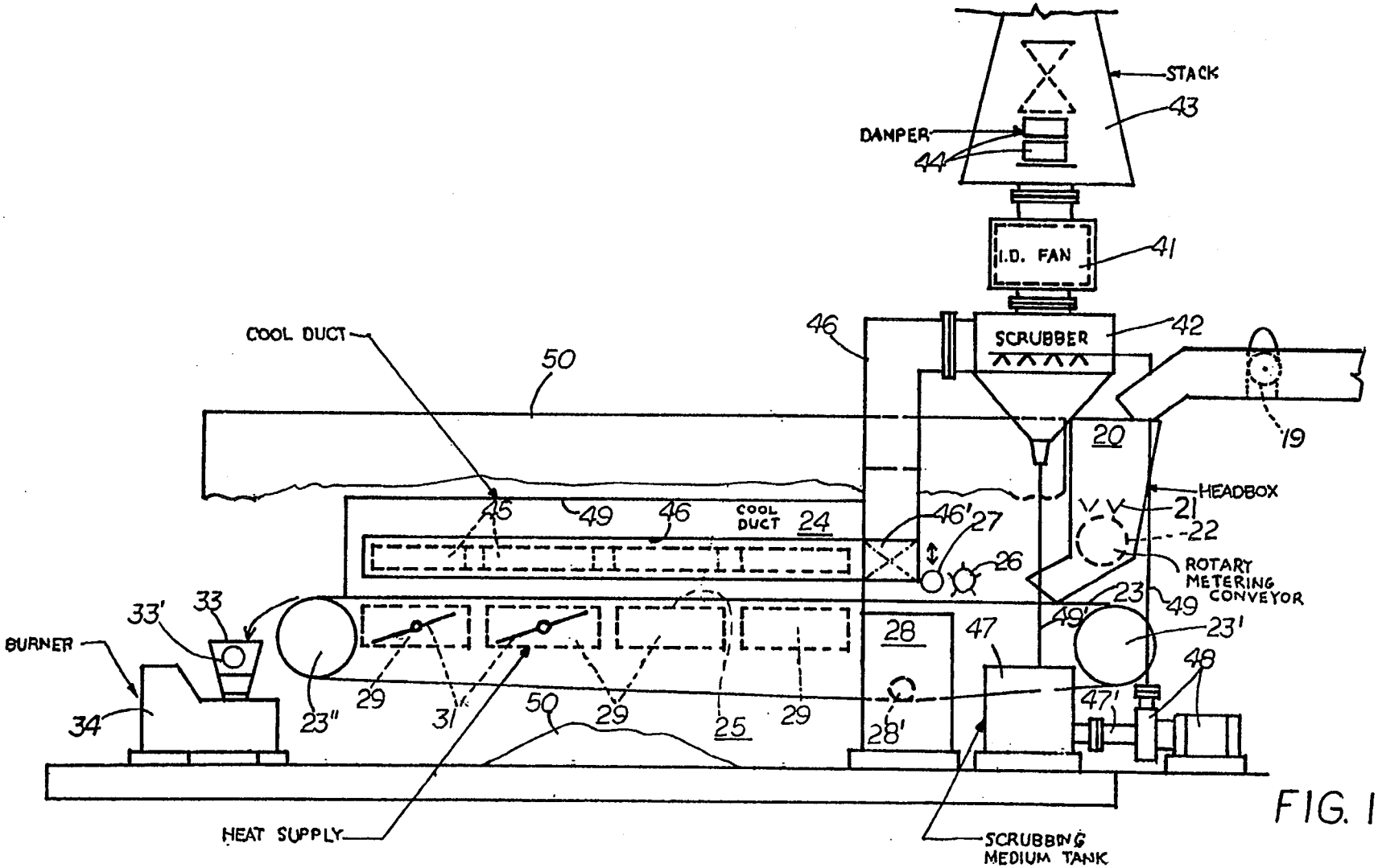

This invention relates to a combined positive controlled sludge dryer and burner for drying and disposing of industrial and municipal cellulose sludge and the burning of the dried sludge to supply energy through generation of steam and electricity.

BACKGROUND OF THE INVENTION

Direct burning of wet cellulose sludge is inefficient and produces unacceptable emissions which are harmful to the atmosphere. A process of drying dewatered cellulose sludge to a 15% water content prepares the sludge that is more suitable for burning. With this drying procedure, combustible gases are supplied for the self-operation of the dryer and for excess use that can be taken off for steam generation and other uses. The final burning converts the dried material to ashes, thus reducing the amount of sludge going to landfills.

It has long been recognized that landfills have posed a great problem because they can contaminate ground water and the atmosphere about them. Accordingly, federal and state regulations have placed many restrictions on their design and maintenance resulting in substantial costs to industry and communities, if, and even when, a suitable site has been found.

From wastewater treatment plants the sludge is dewatered with mechanical presses to reduce the overall water content before it is transported to the landfill, The building up of the landfill, trucking, bulldozer and maintenance can run to $100.00 per ton and more.

Furthermore, the mechanical pressing equipment is expensive to install, operate and maintain. One such press is in the form of a tapered screw operable in a tapered perforated chamber of high structural strength. The sludge is forced along in ever-decreasing space while water under much more pressure is driven through the perforations. The moisture content is reduced to some 40% and considerable horsepower is consumed in the process. In carrying out the present process, this pressed sludge is supplied in its dewatered cake state and after being crumbed and metered the sludge is delivered to a travelling wire screen conveyor and passed through drying chamber assemblies.

An attempt has been made by pulp and paper mills to burn the cellulose sludge. Because the wood fiber will not ignite with a moisture content slightly above 15%, much energy is consumed in the ordinary burning to evaporate excess moisture and the process becomes most inefficient. Burning wet sludge damages the boiler tubes as the products of combustion adhere to the tubes creating blockages and causing increased velocity between the boiler tubes that abrade and erode the tubes.

Tumble dryers have been used with some success, but they lack the control that is necessary to regulate the temperature for the drying of the sludge, thereby resulting in overdrying the sludge and creating an explosive situation due to airborne particles being about.

Hence, there are many disadvantages to current drying methods, such as lack of adequate temperature control, the need for outside fuel, the need to adjust for characteristic changes of the incoming sludge and low production capacities result.

OBJECTS OF THE INVENTION

It is, of course, as with all sludge-reducing procedures the primary object of this invention to minimize the need for landfills and the potential contamination of the ground water and atmosphere.

It is another object of this invention to provide a combined dryer and burner that will most effectively reduce cellulose sludge in large amounts to a 15% moisture content and to pre-condition the sludge for easy burning as part of an energy-producing process.

It is another object of the invention to provide a combined cellulose sludge dryer and burner that will automatically adjust to variations in the feed rate and moisture content of the sludge and provide for the gradual evaporation of the moisture content without ignition and burning of the sludge in dryer.

It is still another object of the invention to provide a combined dryer and burner for disposing of cellulose sludge waste in which that temperature of combustion of the dried sludge will destroy dioxins which may be present in the sludge.

It is a further object of the invention to provide a process for drying and burning of cellulose sludge which can be self-sustaining and maintained in operation from heated air produced in the burning of a portion of its dried material while leaving the remaining dried sludge for outside use of the dryer such as the production of and electricity, the cellulose sludge being processed contains more energy than required to dry it.

It is a further object of the invention to provide a process for the drying and burning of cellulose sludge in which all aspects of the drying process are positively controlled to effect a gradual reduction of the water content and at the end of the process a sludge that will be suitable for burning and for recovery of energy.

It is still a further object of the invention to provide a combined dryer and burner for drying and burning cellulose sludge with a programmed control that will be in response to the moisture content of the cellulose sludge delivered to the drying, such that the drying temperature is critically maintained at 300 degrees Fahrenheit throughout the extent of the drying chamber to avoid burning of the sludge in the dryer and that will deliver a 15% moisture content sludge material prepared for easy burning.

DRAWING DESCRIPTIONS

Figure 2:
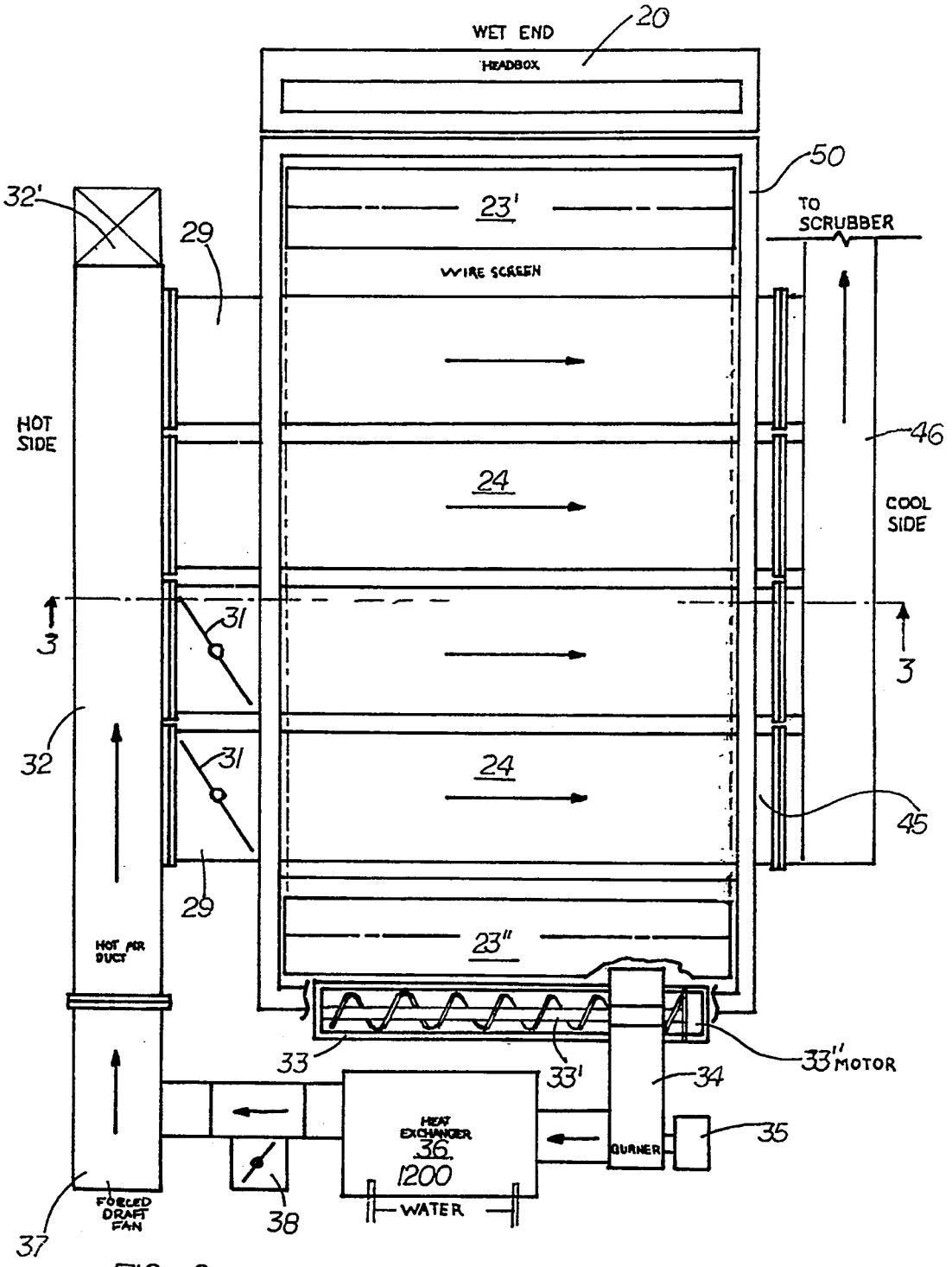
Figure 3:
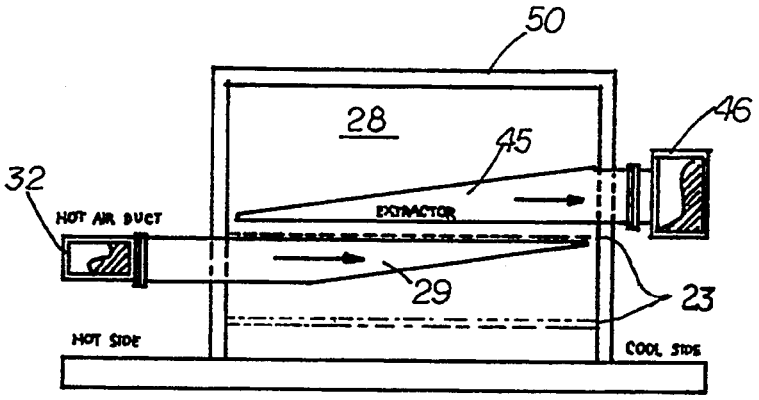
Figure 4:
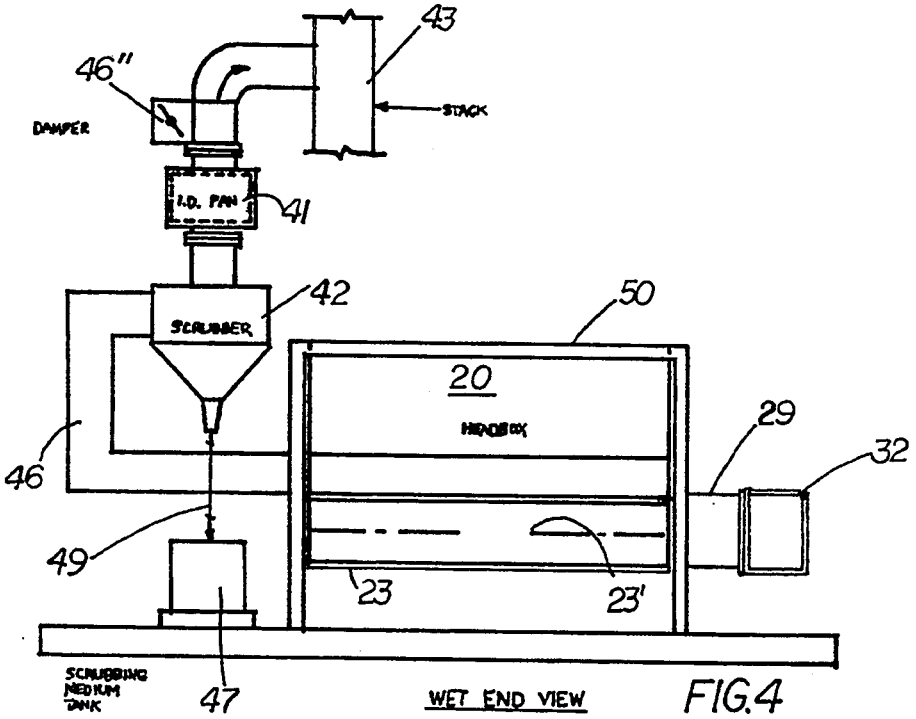
Figure 5:
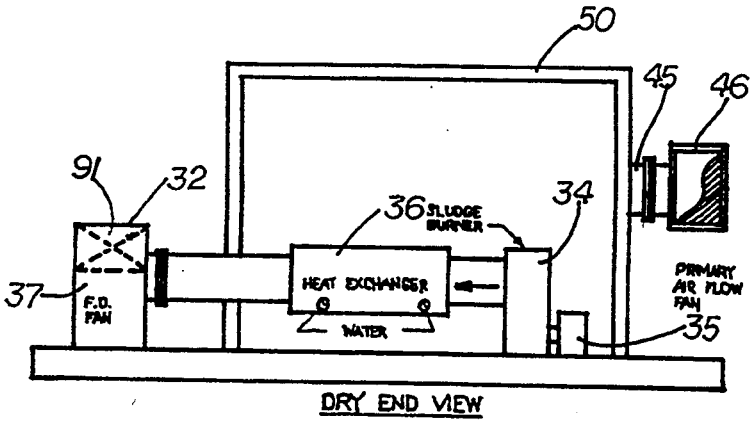
Figures 6, 6A:
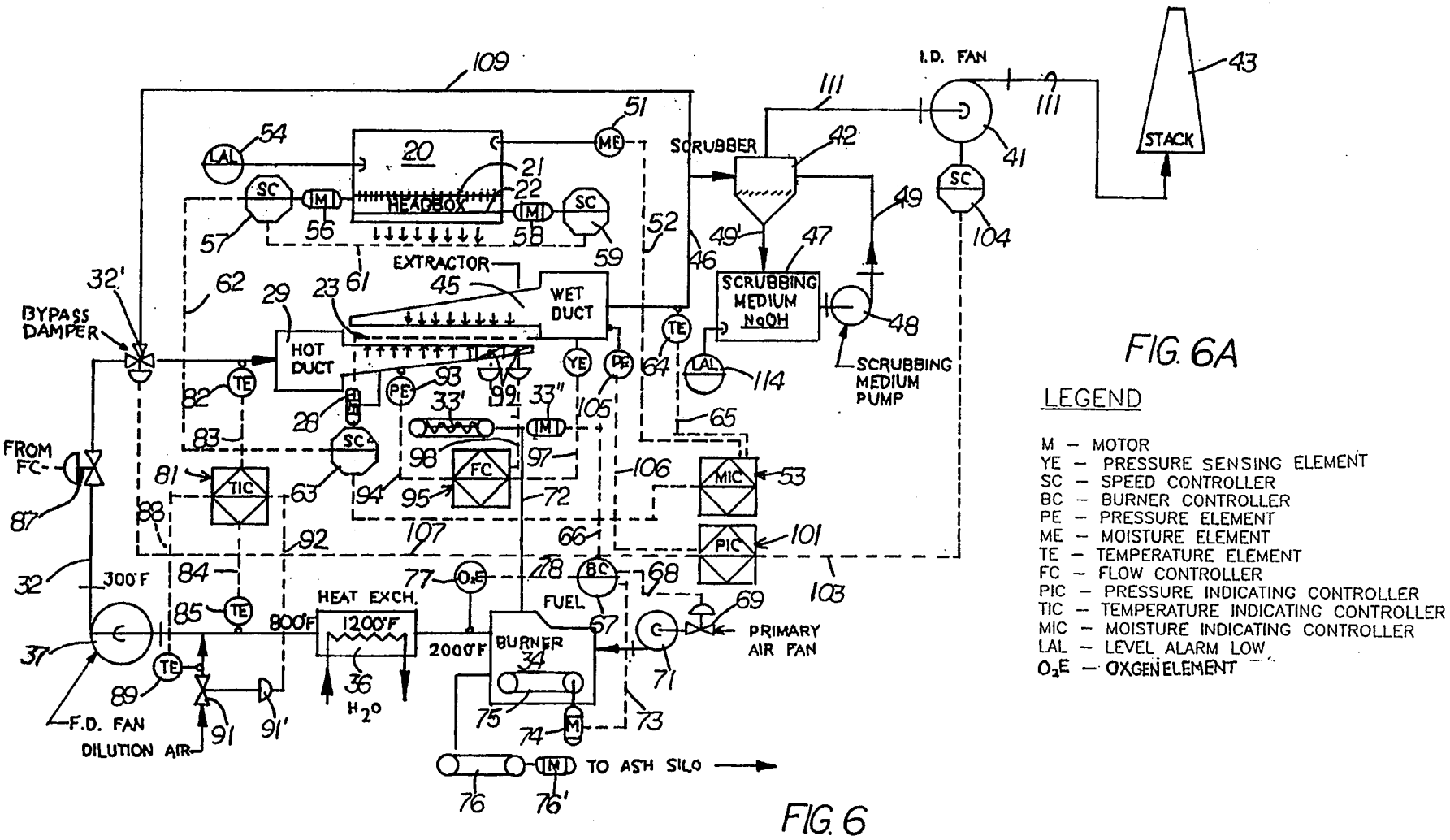

For a better understanding of the invention, reference may be had to the following detailed description taken in connection with the accompanying drawing, in which FIG. 1 is a schematic elevational view of the cool side of the apparatus in which the cellulose sludge drying and burning process of the present invention is carried out, FIG. 2 is a schematic top plan view of the apparatus, FIG. 3 is a schematic vertical sectional view of the apparatus as viewed on line 3—3 of FIG. 2 and looking in the direction of the arrows thereof, FIG. 4 is a schematic wet end elevational view of the apparatus, FIG. 5 is a schematic dry end elevational view of the apparatus, FIG. 6 is a programmable control diagram of the cellulose sludge drying and burning process as carried out in aforementioned apparatus.

FIG. 6A is a legend indicating the elements of FIG. 6.

DETAIL DESCRIPTION

The sludge that comes from the mechanical presses is caked and delivered to the dryer headbox directly and continuously where the caked sludge is reduced by crumbing to a pre-determined particle size by a crumber device end after which the particles are dropped onto a rotary metering conveyor and deposited in measured amounts onto an endless travelling wire screen conveyor with a counter-rotating roll for distributing thereover and a vertically adjustable depth gauge roll to insure a uniform depth of sludge entering the drying chamber. Within the elongated drying chamber is a series of opposed hot air and extraction duct assemblies with their hot air duct lying beneath the wire screen conveyor and the extracting ducts respectively lying thereover and above the sludge. There will be no burning in the drying process.

Sludge, as it comes from the lagoon of the sewerage treatment plant, is generally 96% water and 4% solid, by weight, and before the sludge is delivered to the present dryer, it will have been passed through a conical-type mechanical press 19 and reduced to 40% water and 60% solid cellulose content, by weight. If the location of the mechanical press permits attaching to the dryer directly, then the caked sludge can be passed to the dryer as a continuing process. Should the arrangement not be practical and the dryer is located some distance from the mechanical press, then delivery would be made by a conveyor or truck-transported. Thereafter, further reduction of the water content will be effected in the present dryer under positive control conditions to render a 15% moisture content sludge as will now be described in detail herein.

Hence, caked sludge is continuously delivered to a headbox 20, FIG. 1, that has a crumber assembly 21 therein that breaks up the caked material into crumb particles which are dropped onto a rotary metering conveyor 22 also within the headbox from which measured amounts of the crumb particles are continuously fed to an endless travelling wire screen conveyor 23. This conveyor extends through an elongated drying chamber 24 over the wire screen before entering the chamber 24. A motor-driven counter-rotating roll device 26 distributes the sludge crumb particles across the wire screen conveyor 23 and a vertically-adjustable depth gauge structure is used to establish a uniform depth of the particles entering drying chamber 24. A motor 28 and pinion 28' drives the wire screen conveyor 23 over its wet and dry rolls 23' and 23''.

There are a series of opposing duct drying assemblies 25 located along the loaded portion of the screen wire conveyor 23. The drying air is supplied from respective individual hot air supply ducts 29 respectively lying beneath the conveyor. Certain of these hot air supply ducts 29 will have dampers 31 particularly for the ducts near to the discharging end of drying chamber 24 to reduce hot air supply and to prevent the sludge from becoming airborne at the end of the drying cycle. The ducts 29 are supplied from a main hot air duct 32 with hot air generated by burning of the dried sludge. Since cellulose wood fibers char at temperatures approaching 320 degrees Fahrenheit, the drying chamber 25 needs to be maintained with a temperature substantially at 300 degrees Fahrenheit. The speed of screen wire 23 will be determined by resident time needed to evaporate the moisture of dewatered sludge to a final 15% moisture content. As the sludge becomes increasingly dryer, the hot air velocity at each chamber assembly 25 will tend to cause the particles of the dried sludge to become airborne. To prevent this from happening, downstream chamber assemblies 25 will be equipped with photoelectric cells directed across the downstream hot air drying chamber 24 to effect appropriate control for activation of the dampers 31 associated therewith. Only some 30% by weight of the dried sludge needs to be burned to dry all the sludge. With 100% of the sludge being dried, the weight of the sludge is reduced by over 80% when supplied from the discharge end of the conveyor 23.

The moisture from the sludge, as it is evaporated is extracted by an induced draft fan 41. The extracted wet airflow is passed through a scrubber 42 to remove gases and particular matter and then delivered through a stack 43 with a damper 44 to the atmosphere.

The extraction system is located on the cool side of the apparatus opposite the hot air supply system and includes opposing extractor ducts 45 respectively overlying the respective hot air supply ducts 29 of the respective drying chamber assemblies 25 that create a negative pressure thereabove. The cooled air extracted by these ducts 43 is passed through a main wet air duct 46 to the scrubber 42 whereby the extracted air is cleaned before leading to the atmosphere through stack 43. The chemical scrubbing medium is taken from a tank 47 lying below the scrubber 42 and pumped through pipeline 49 into the scrubber 42 by a motor-driven pump 48 and returned through drain pipe 49'. Dampers 44 and 46 are provided in the extractor system, FIGS. 1 and 2, to control the suction of air and maintain proper negative pressure and temperature from the drying chamber 24 in which there can be any number of such assemblies 25 other than the four chamber assemblies shown and dependent upon the extent and capacity of the combined dryer and burner to be fabricated. In either extent, their temperature settings will be programmed into controllers and controlled automatically in a manner to be described later herein in connection with FIG. 6. An overall enclosure 50 surrounds the drying chamber 24 and duct assemblies 25 to lessen fluctuations in temperature from the outside atmosphere.

The rotary metering conveyor 22 in the headbox deposits a precise volume of sludge particles upon the wire screen conveyor 23 to pass under the distribution roll 26 and adjustable depth gauge roller 27 and to deposit a pre-determined depth of the sludge upon the travelling wire screen conveyor 23 and yet having a variable moisture content of 40% and which could run as high as 80%. The depth of the sludge supplied to the wire screen conveyor 23 depends upon its moisture content, as well as the speed of the travelling screen conveyor 23 and the drying temperatures and pressures of the drying chamber 24 in a programmed manner as will be readily seen when description is made further with reference to the control diagram in FIG. 6.

The wire screen conveyor 23 carries and discharges the dried sludge into a transverse-receiving trough or bin 33 with a 15% moisture content and most suitable for burning. The dried cellulose burns without need of supplemental heat to drive off moisture content. The trough or fuel bin 33 has a screw conveyor 33' that carries the 15% dried sludge to the burner 34, which will burn some 30% of the dried sludge to produce the hot air for delivery to the series of hot ducts 29 underlying the travelling wire screen 23 carrying the sludge being dried. The remaining 70% of the dried sludge can be used as a viable fuel in a power-producing boiler for outside purposes for steam and electricity. The burner 34 on burning the dried sludge creates sufficient heat in the heat exchanger 36 to reduce the hot air temperature from 2,000 degrees Fahrenheit to 800 degrees Fahrenheit while raising the water temperature being delivered from the heat exchanger 36. The burner will have generated 2,000 to 2,200-degree Fahrenheit temperatures sufficient to destroy dioxins. In the present process, the remaining 800 degrees Fahrenheit is directed through main hot air duct 32 to hot air ducts 29 and the drying chamber 24. Since cellulose sludge chars at over 300 degrees Fahrenheit, damper-controlled dilution air from the atmosphere is admitted to reduce the high temperature of 800 degrees Fahrenheit to some 300 degrees Fahrenheit before entering the hot air ducts 29 under the travelling wire screen conveyor 23 bearing the sludge material. The heat zone and speed of the wire screen is designed for adequate length and timing so that the sludge material will have a moisture content of 15% on discharge and be ready to be easily burned. The moisture-laden air produced during the drying process is extracted immediately by the extracting ducts 45 overlying and respectively opposing the respective hot air ducts 29 and operated at negative pressure that is maintained by control of the induced draft fan 41 and the use of dampers in the extracted air passages to the scrubber 42.

Through wet ducts 45 and main duct 46 the moisture-laden air from the drying chamber 24 is led to scrubber 44 to remove acid gases and particular matter produced by the burner 34. Matter normally associated with the burning of cellulose sludge will be entrapped in the sludge material being dried and not likely to reach the scrubber 42. With the use of the dampers 44 and 46 a by-pass damper 32' from the main hot air duct 32 to main wet air duct 46, the entire scrubber discharge is directed through stack 43 to the atmosphere.

By burning the dried sludge and sending the steam from a heat exchanger to a turbine generator, a recovery of cost may be had from the production of sand sale of the electricity generated from the sludge that will more than offset drying costs, and only with but a part of the dried sludge being used to provide heat for the drying process. An outside source of fuel for drying has been unnecessary with the present process. Wet sludge is not easily burned without excessive fuel from outside. Hence, there is a need for drying the sludge prior to burning and particularly in a process whereby the heated air is supplied from dried sludge itself with still enough fuel for the separate generation of electricity and with drying the entire process being positively and automatically Controlled much saving in costs is had. Ordinary burners for the burning of sludge are expensive and inefficient due to high moisture content of the sludge. With the present process, this drying and burning of the sludge is carried out continuously without interference and by means of burner controls interacting with dryer controls.

The sludge, by use of the wire screen conveyor 23, is passed over the hot air ducts 29 underlying the wire screen and transversely across the drying chamber 24 and supplied with hot air from main delivery duct 32 that runs along the hot side of the dryer, FIGS. 2 and 3. The ducts 29 are elongated and of gradient design. The hot air generated from the burner 34 forming a part of the equipment easily burns the resultant dried 15% moisture content sludge leaving the drying chamber 24. An air temperature of some 2,000 degrees Fahrenheit is produced by the burner 34 and on passing through the heat exchanger 36 is reduced to 800 degrees Fahrenheit and then with the admission of outside air brought to a useable temperature of 300 degrees Fahrenheit for delivery through main hot air duct 32 and hot air ducts 29 to drying chamber 24. An uncharred sludge is thereby delivered to the burner with full energy being available. The heated air is delivered from the heat exchanger 36 by forced draft fan 37 taken in through dampers as later set forth in a description of FIG. 6 and air from the outside to deliver hot air at the same 300-degree Fahrenheit temperature to the drying chamber 24. The dried and unburned sludge is dropped into the trough or fuel bin 33 and by its laterally-extending discharge conveyor 33' is delivered to the burner 34. Steam will be taken from the heat exchanger 36 to a turbine-generating plant and converted to electricity for external use. There is always an over-abundance of burnable sludge for providing the hot air needed for the continued drying process.

Underlying the sludge in the drying chamber 24 and wire screen are the gradient flow hot air ducts 29 while overlying the sludge on the screen conveyor are respective vertically-aligned extractor ducts 45 for taking off the wet air collected from over the drying sludge mass and through the main extracting duct 46 running along the cool side of the drying chamber 24, opposite from the hot air main duct 32, for delivery to the scrubber 42 before being exhausted to the atmosphere. By use of a dampered-controlled induced draft fan 41 the scrubbed air is delivered from the scrubber to a damper-controlled chimney stack 43 and atmosphere.

The crumbed sludge is deposited in measured quantities upon the wire screen 23 and in response to its precise moisture content and with apparatus programmed for drying unburned and dried sludge at the end of its passage through the drying chamber that contains but the 15% moisture content and ready to be burned to supply the hot air for the drying process and steam for a turbine-generating plant. Hence, moisture-laden air is extracted from the chamber and is passed to the scrubber atmosphere-free of harmful gases and dioxins.

The apparatus for carrying out the process includes programmed controllers responsive to various moisture, temperature and pressure-sensitive elements associated with each of the stages of the process to effect continuous automatic drying and burning of the sludge mass. The computer programmed controllers once set to a given mass will in response to the moisture content of dewatered sludge delivered in the headbox 20 positively control the process through the different stages so as to discharge dried sludge with but a 15% water content suitable to be burned and then burn to supply the hot air for the drying process within the drying chamber 24. To take the sludge to less than the 15% moisture content, the material will be disintegrated and unsuitable for proper handling in the burning process.

Referring now to the control diagram shown in FIG. 6, the cellulose sludge is delivered to the headbox 20 having had its water content reduced to approximately 40% as taken from an aforementioned conical screw press Wherein it is measured with strict accuracy by a moisture-determining element 51 that is connected by wire 52 to a programmable moisture-indicating controller 53 (MIC). The headbox 20 serves as a short-term storage, and the level of the sludge therein is maintained above ascertain low level point which, upon being reached, sets off a low level alarm 54 calling for more sludge to be delivered to the headbox 20.

Other than with conical screw press, dewatering is most commonly performed by a belt press. With such belt presses, the anticipated moisture content will range from 60% to 80%. Due to this unique programmable positive control of the present apparatus such pressed sludge can be dried to the 15% moisture content regardless of its dewatered moisture content. The pressed sludge being dewatered is caked on delivery to the headbox 20.

The sludge cakes are crumbed in the headbox by crumbing assembly 21 driven by motor 56 which is speed-controlled by a speed controller 57 to reduce the sludge to usable particle sizes. The sludge particles are dropped onto the rotary metering conveyor 22 that is driven by a motor 58 controlled by a speed controller 59 to deposit measured amounts of the sludge particles onto the travelling wire screen 23 for delivery through the series of drying chamber assemblies 25. Both the crumbing assembly 21 and the rotary conveyor motors 56 and 58 are connected in parallel through their speed controllers 57 and 59 by a wire connection 61 and through a wire connection 62 with the programmable moisture-indicating controller 53 along with a speed controller 63 for controlling the speed of motor 28 and the travel of the wire screen conveyor 23 containing the sludge being passed through the drying chamber 24 and the drying chamber assemblies 25.

The crumber, metering and wire screw conveyors each have individual speed controllers (SC) as above set forth and are kept at a speed set point by the moisture-indicating controller 53 (MIC) in response to the moisture-determining element 51 in contact with the sludge delivered to the headbox 20. This controller 53 thus monitors the sludge passage through the crumber, metering and wire screen conveyors in response to the moisture-determining element 51 at the headbox 20 for the incoming sludge being delivered thereto. This same controller 53 also monitors through temperature element 64 and wire 65 in the exhaust wet duct 46 to sense the temperature of the air leaving the drying chamber 24. Through test it has been proven that with 300 degree Fahrenheit drying air, it requires a 175 degree Fahrenheit drop in temperature across the sludge on the wire screen to dry the sludge to 15% moisture content to render the sludge suitable for burning. Thus, the extracted wet air must be maintained at 125 degrees Fahrenheit in main wet air duct 46 delivering extracted air to scrubber 42 as determined from temperature element 64. When the extracted air temperature deviates from the set point, the bed depth is changed to bring the temperature back to the set point. Changing the bed depth of the sludge upon the wire screen conveyor 23 and changing the speed of the conveyor alters the production rate of the process. Thus, to maintain the production set point, the speeds of the crumber 21, the rotary metering conveyor 22 and wire screen conveyor are changed through the programmed moisture controller 53.

The drying air is provided by the burner 34 that takes the dried 15% moisture content material that has been discharged into the fuel supply bin 33 and by a screw conveyor 33' therein driven by a motor 33'' and delivers the dried sludge to the burner 34 from one end of the bin 33.

The screw conveyor motor 33'' is connected by a wire connection 66 with a burner controller 67 (BC) and by a connection 68 to a damper 69 that will control the air flow that is delivered by a primary air fan 71 for delivery to the burner 34 while at the same time already having delivered dried sludge fuel with but a 15% moisture content from the screw conveyor 33' to the burner 34 as indicated by full line 72. A further control wire connection 73 runs from the burner controller 67 to a drive motor 74 that operates a burner ash conveyor 75. This ash conveyor delivers the ash produced in the burner 34 to an outside conveyor 76 driven by motor 76' which will deliver the final ash for final disposal.

The burner controller 67 controls the fuel feed rate of the dried sludge from discharge and fuel bin 33 and the primary combustion air flow of the primary supply fan 71 while maintaining an excess oxygen setpoint through an oxygen-measuring element 77 connected with the burner controller 67 by wire connector 78 and with the output burner air at 2,000 degree Fahrenheit temperature. The burner 34 is rated to consume 100% of the dried sludge discharged from the drying chamber 24. Portions of the dried sludge if desired may be taken for outside purposes.

To reduce the temperature of the output hot air from the burner 34 to approximately 800 degrees Fahrenheit, the heat exchanger 36 is used. The steam produced will be delivered to an outside location for use as a heating supply and/or for generation of electricity.

The drying temperature being delivered through hot air ducts 29 to the drying chamber 24 must be maintained at 300 degrees Fahrenheit in order to avoid charring the sludge during the drying procedure. A temperature-indicating controller 81 (TIC) is programmed to measure the diluted air temperature as the air enters the drying chamber 24 by a temperature element 82 and wire connection 83 and temperature element 85 and line connection 84 to exhaust air of the heat exchanger 36 so that there will be an adequate temperature drop before delivery of the hot air to ducts 29 from 800 degrees of air from the heat exchanger to the hot air ducts 29.

This temperature-indicating controller 81 uses these values to calculate the volume of diluted hot air needed to maintain 300 degrees Fahrenheit in the drying chamber 24 by controlling the temperature of the air entering the hot air ducts 29 leading to the drying chamber 24. To be sure of the proper drying of the sludge on the wire screen conveyor 23, a positive pressure of air delivered from the hot air ducts 29 below the wire screen and a positive negative pressure from the opposing wet ducts 45 to extract the wet air from above the sludge mat on the screen conveyor must also be maintained.

A wire connection 88 extends from the temperature-indicating controller 81 to a temperature element 89 that leads from a dilution air valve 91 that is operated by an activator 91' through a wire connection 92 with the temperature controller 81 to reduce the temperature delivered to forced draft fan 37 from the heat exchanger 36.

A pressure-sensing element 93 (PE) is connected to one gradient hot air duct 29 and by a wire connection 94 and to programmed flow controller 95 (FC) and a pressure-sending element (YE) located within the wet duct 45 to be connected by a wire connection 97 to the flow controller 95 whereby to register differences of pressure of the hot air and wet air ducts from the flow controller 95 and to maintain the programmed difference of pressure as between the ducts.

From the flow controller 95, a wire connection 98 connects with two dampers 99 in the air duct 29 within the drying chamber 24 at the discharging end thereof to lessen and control the temperature of the drying air at this location and prohibit last minute charring of the dried sludge on leaving the drying chamber 24. These dampers 99 while shown in the diagram at the outer end of an air duct may be located in the intake end, of the air ducts 29 as seen at 31 in FIG. 2 and would be similarly connected to the flow controller 95 as are the dampers 99 at the outer end of the air duct 29 as in the diagram. The hot air duct dampers 31 or 99 of air duct 29 will thus control the air flow entering the drying chamber 28. The sludge passing the trailing hot air ducts 29 of the drying chamber 24 may require less drying air than the ducts 29 at the beginning of the drying procedure. Dried sludge at the discharge end of the chamber 24 will have a tendency to become airborne and photoelectric sensors will be used to detect this particular density above the screen conveyor 23 and signal the flow controller 95 to restrict the air flow to the hot air ducts 29.

A pressure-indicating controller 101 (PIC) determines the speed of the induced draft fan 102 through the wire connection 103 and speed controller 104 and in response to a pressure element 105 in the wet ducts 45 connected by a line connection 106 with the pressure-indicating controller 101. Through a line connection 107 connected from the pressure-indicating controller 101 to a by-pass damper 108 in the hot air duct 32 that will in response to the pressure element in the wet duct 45 cause pressure controller 101 to be opened or closed with the speed of the induction draft fan 102 through its speed controller 104. By-passed hot air is led off through a duct 109 to join main wet duct 46 for delivery through main wet duct 46 to the scrubber 42, and then through induced draft fan connections 111 directly to chimney stack 43 from the induced draft fan 41.

The scrubber 42 is supplied with scrubbing medium such as sodium hydroxide, NaOH, from scrubbing medium tank 47 by the motor-operated pump 48 and circulated through the scrubber and return line 49, FIG. 1. A low level alarm 114 is used with the scrubbing medium tank 47 to give alarm when the scrubbing medium is low and needs to be replenished. Air pollution control is thus obtained.

It should be understood that it is essential throughout the drying procedure that the drying temperature within the drying chamber be maintained at 300 degrees Fahrenheit to avoid charring and burning of the sludge and that all concern has been made by the use of heat exchanger, travelling conveyor speed and various dampers and their controls therefor be done automatically and in response to the amount of moisture content of the sludge material as it is supplied to the dryer headbox and by use of the several programmed moisture controllers 53, 81, 95 and 101. Also, to make sure that the sludge is discharged from the conveyor with but 15% moisture content and in such state that it is delivered to the burner 34 suitable for burning.

By the use of four programmable controllers namely a moisture-indicating controller, a temperature-indicating controller, a flow controller and a pressure-indicating controller and sensing elements located throughout the apparatus to serve these controllers along with an oxygen element to control the speed of the burner motor, an effective, positive and automatic control has been provided for a combined sludge dryer and burner.

A most suitable apparatus has been designed to make use of such an effective positive control system in an apparatus utilizing opposing hot air and extracting ducts within the drying chamber. Such apparatus not only supplies its drying air, but has an abundance of easily burnable sludge that can be used to supply steam and electricity separate from the unit for outside purposes.

It should also be seen that by the use of opposing hot air and extracting ducts that the most effective control will be from them and from both inlet and outlet sides of the drying chamber, that critical, positive and delicate control of the drying procedure is had and unburned dried sludge will be discharged from the drying chamber 24 to the burner 34. With over-abundance of drying air supplied from burning the discharged dried sludge steam is taken off from the heat exchanger for outside heating and generation of electricity. The efficiency from the use of opposed drying and extraction ducts and the induction draft fan allows for programmable control to be effective for delivery of 15% moisture content suitable for burning.

While various detail changes may be made in the overall construction of the dryer and burner and slight deviations in the carrying out of the drying and burning procedures, it should be understood that such changes shall be within the spirit and scope of the invention as defined by the appended claims.

What is claimed is:

1. A combined positive-controlled cellulose sludge dryer and burner process for drying and burning cellulose sludge that consists of the steps of dewatering the raw sludge by a mechanical press to reduce the water content to some 40% or more of its weight and provide a supply of caked sludge, crumbing the caked sludge, metering and depositing the sludge crumbs onto a travelling wire screen conveyor, passing the material through a drying chamber and between opposing hot air and wet air extraction ducts assemblies to dry the sludge to have a moisture content of some 15%, removing the dried sludge from the wire screen and burning it to heat air for delivery to the hot air ducts and drying chamber to dry the sludge therein and automatically maintaining through appropriate controls a drying temperature of some 300 degrees Fahrenheit within the drying chamber and finally by means of the wet air extracting ducts exhausting the moisture-laden air and gases from the drying chamber to the atmosphere.

2. A combined positive-controlled cellulose sludge dryer and burner process for drying and burning cellulose sludge as defined in claim 1 and metering the amount of crumbed sludge supply to the travelling wire screen in response to the moisture content of the dewatered sludge delivered to the dryer.

3. A combined positive-controlled cellulose sludge dryer and burner process for drying and burning of the cellulose sludge as defined in claim 2 and interposing heat exchanger to reduce the temperature of the hot air being supplied to the drying chamber for drying process by the burner and outside air-receiving dampers for the delivery of heated drying air to maintain the temperature of some 300 degrees Fahrenheit within the drying chamber.

4. A combined positive-controlled cellulose sludge dryer and burner process for drying and burning cellulose sludge as defined in claim 3 and scrubbing the moisture-laden air discharged from the drying chamber on being passed to the atmosphere.

5. A combined positive-controlled cellulose sludge dryer and burner for drying and burning cellulose sludge as defined in claim 4 and in response to the moisture content of delivered dewatered sludge, programmably controlling the crumbing of the dewatered sludge, the metering of sludge onto the conveyor and the speed of the travelling wire screen conveyor to time the exposure of the sludge within the drying chamber.

6. A combined positive-controlled cellulose sludge dryer and burner as defined in claim 5 and further in response to the extracting pressure of the heating chambers program controlling by-pass of the supply of drying air being delivered to the drying chamber, to the scrubber and atmosphere.

7. A combined positive-controlled cellulose sludge dryer and burner as defined in claim 6 and further in response to the oxygen content of the discharged hot air from the burner controlling the supply of discharged dried fuel from the dryer to the burner and the delivery of heated air to the hot air ducts.

8. A combined positive-controlled cellulose sludge dryer and burner as defined in claim 7 and further controlling the discharge of ash from the burner.

9. A combined positive-controlled cellulose sludge dryer and burner as defined in claim 8 and passing the heated air through a heat exchanger to reduce its temperature preparatory to delivery to the hot air ducts and drying chamber.

10. A combined positive-controlled cellulose sludge dryer and burner as defined in claim 9 and further in response to a temperature differential between the heated air from the heat exchanger and the heated air on delivery to the dryer whereby to control the temperature of air being force-drafted to the dryer.

11. A combined cellulose sludge dryer and burner comprising a headbox for receiving wet sludge, a travelling wire screen conveyor onto which sludge from the headbox is deposited, an elongated drying chamber, said wire screen conveyor extending through the drying chamber, a series of opposing hot air and extracting ducts extending along the conveyor within the drying chamber, the hot air duct extending beneath the wire screen conveyor and the extracting wet duct lying over the conveyor and above the sludge to extract the wet air from the drying chamber and delivery of the same to the atmosphere, means for burning the dried sludge material discharged from the conveyor and delivering hot drying air to the hot air ducts and positive control means operable in response to the moisture content of the sludge delivered to the headbox, maintaining a drying temperature of some 300 degrees Fahrenheit within the drying chamber.

12. A combined cellulose sludge dryer and burner as defined in claim 11 and said opposing hot and wet air ducts being of the gradient type for the release of hot air to the drying chamber and for the extraction of the wet air therefrom.

13. A combined cellulose sludge dryer and burner as defined in claim 12 and said positive control means for maintaining the some 300 degrees Fahrenheit air temperature, including programmable controllers for metering the supply of the dewatered cellulose sludge being delivered to the travelling conveyor, the speed of the travelling conveyor, and damper control in response to temperature and pressure in the drying chamber for delivery of heated air to the hot air ducts and the extraction of the wet air from the drying chamber.

14. A combined cellulose sludge dryer and burner as defined in claim 13 and a heat exchanger interposed in the hot air supply from the burner to reduce the temperature of the air being delivered to the hot air ducts and to supply steam energy for outside use.

15. A combined cellulose sludge dryer and burner as defined in claim 14 and an air scrubber assembly interposed in the passage of the wet air from the dryer to the atmosphere.

16. A combined cellulose sludge dryer and burner as defined in claim 15 and means in response to pressure within a wet duct for by-passing heated air being delivered to the hot air ducts.

* * * * *